United States Patent [19]

Woron et al.

[11] 4,147,083

[45] Apr. 3, 1979

[54] PROGRAMMABLE VOICE CHARACTERISTIC MEMORY SYSTEM

[75] Inventors: Robert P. Woron, Allentown; J. Thomas Whitefield, Harleysville; Steven R. Roth, Macungie, all of Pa.

[73] Assignee: Allen Organ Company, Macungie, Pa.

[21] Appl. No.: 751,246

[22] Filed: Dec. 16, 1976

[51] Int. Cl.[2] ..... G10H 1/00

[52] U.S. Cl. ..... 84/1.01; 84/1.03; 84/1.19; 84/1.26

[58] Field of Search ..... 84/1.01, 1.03, 1.13, 84/1.18, 1.26, 115, 462, 1.11, 1.19

[56] References Cited

U.S. PATENT DOCUMENTS

| | | | |
|---|---|---|---|
| 3,764,721 | 10/1973 | Maynard | 84/1.19 |
| 3,913,442 | 10/1975 | Deutsch | 84/1.11 |
| 3,926,088 | 12/1975 | Davis | 84/1.03 |
| 4,078,465 | 3/1978 | Wheelwright | 84/1.03 |

*Primary Examiner*—Robert K. Schaefer
*Assistant Examiner*—Leonard W. Pojunas, Jr.
*Attorney, Agent, or Firm*—Seidel, Gonda, Goldhammer & Panitch

[57] ABSTRACT

A programmable voice characteristic memory system for programming any number of different specifications in an electronic digital organ. Digital information which defines voice characteristics in an electronic digital organ is stored in a read-write specification memory. Voice characteristic information may be selectively written into the specification memory from an external data inputting device such as a punched card reader or from an external non-volatile read-write memory such as a magnetic tape. Information stored in the specification memory may be transferred to and recorded on the external non-volatile read-write memory for permanent storage and future use. Voice characteristic information stored in the specification memory may also be accessed by the digital organ to generate musical tones in conventional fashion.

12 Claims, 8 Drawing Figures

FIG. 2 DATA INPUT MODE

DATA INPUT MEANS

OPTICAL CARD READER

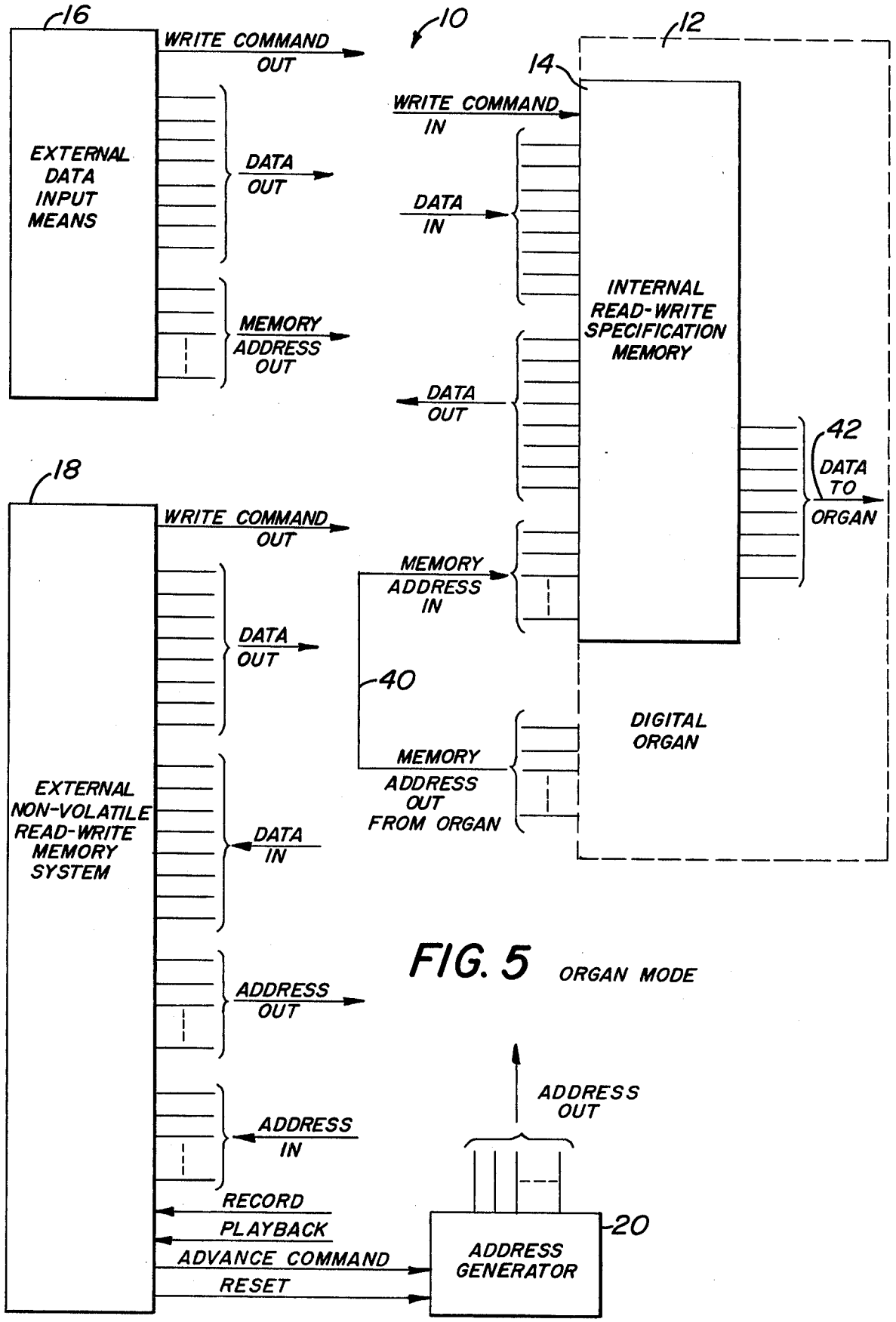
FIG. 5 ORGAN MODE

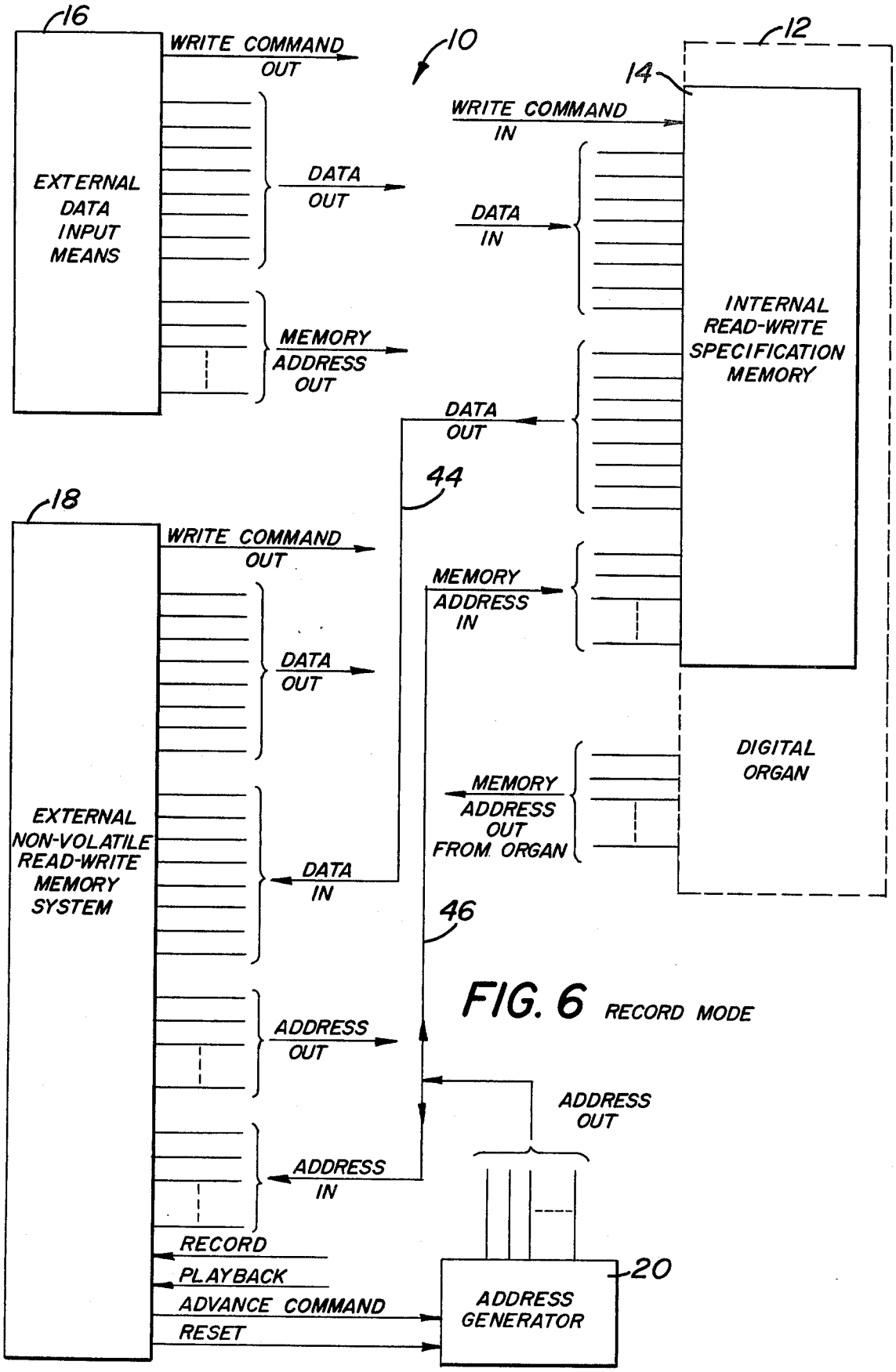
FIG. 6 RECORD MODE

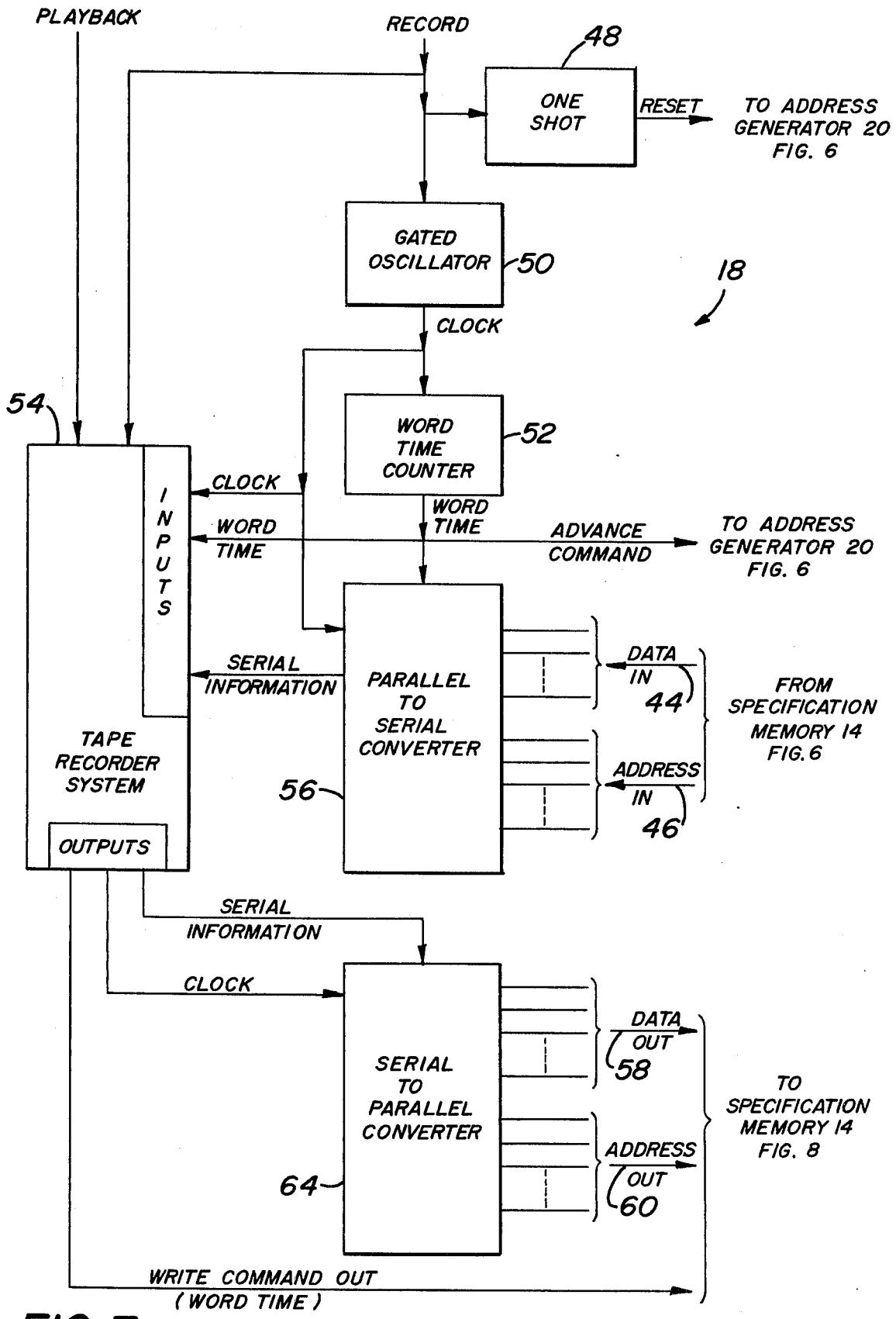
FIG. 7 EXTERNAL NON-VOLATILE READ-WRITE MEMORY SYSTEM

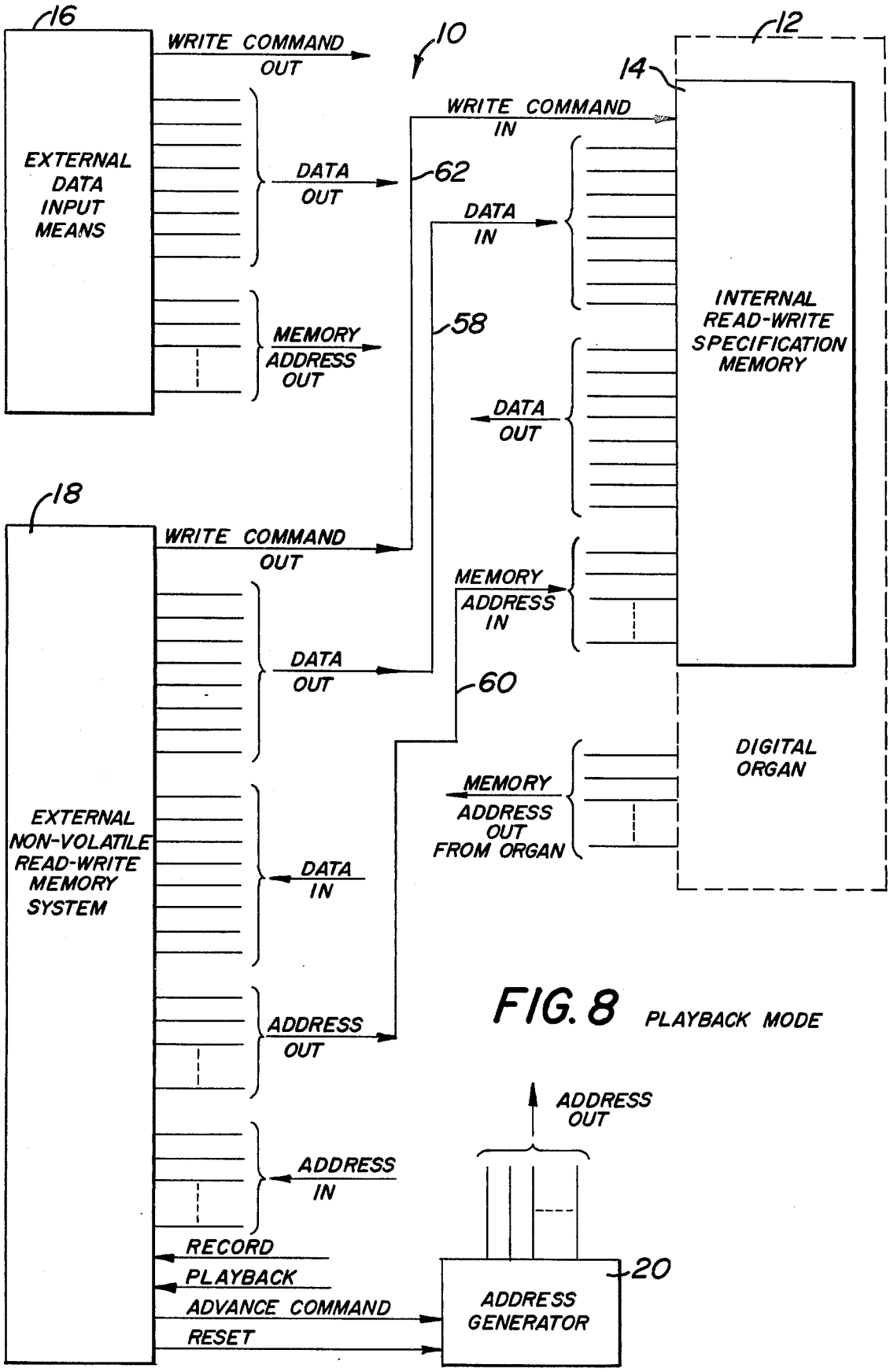
FIG. 8 PLAYBACK MODE

PROGRAMMABLE VOICE CHARACTERISTIC MEMORY SYSTEM

BACKGROUND OF THE INVENTION

The present invention is directed to a voice characteristic memory system for use in an electronic digital organ. In particular, the invention is directed to a programmable voice characteristic memory system which can be selectively and conveniently programmed to provide a virtually unlimited number of voices at the fingertips of the organist or organ designer.

An organ voice is the timbre or harmonic tone structure of the musical tone generated by the organ. Voices are generally characterized as diapason, flute, reed, string, special effects and so forth. The complete listing of voices in an organ is referred to as the organ specification.

Heretofore, the specification of an electronic digital organ was "hard wired" into a non-programmable memory such as a ROM. To alter the specification of such an organ, it was necessary to replace the ROM at the factory. The specification could not be directly and conveniently altered by the organist without providing relatively complex additional circuitry. For example, see U.S. Pat. Nos. 3,515,792 to Deutsch, 3,610,799 to Watson and 3,755,608 to Deutsch.

Various "capture combination" systems for combining voices in an organ specification are also known in the art. For example, see U.S. Pat. Nos. 3,733,593 to Molnar and 3,926,087 to Griffis. These systems are merely directed to techniques for facilitating selection of various combinations of organ stops without affecting the voices stored in the organ specification memory.

A primary advantage of the present invention is that it facilitates rapid, convenient alteration of an organ specification either voice by voice or all voices in gross.

Another advantage of the invention is that it provides for the recordal of the voice characteristic information of a particular organ specification in an external non-volatile memory for convenient storage and retrieval by the organist.

A further advantage of the invention is that it provides a virtually unlimited number of voices for use by the organist.

Other advantages appear hereinafter in the following disclosure.

SUMMARY OF THE INVENTION

A programmable voice characteristic memory system comprising an internal read-write specification memory for storage of voice characteristic information representative of a plurality of voices. Means for writing into the internal read-write memory voice characteristic information from an external non-volatile read-write memory. Means for writing into the internal read-write memory voice characteristic information selectively provided by external data input means. And means for non-destructively reading out of the internal read-write memory voice characteristic information stored therein and for transferring that information to the external non-volatile read-write memory.

The external data input means may comprise a punched card reader. The external non-volatile read-write memory may comprise a magnetic tape recorder. The internal read-write memory may be a random access memory.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 5 is a block diagram of the invention in the organ mode.

FIG. 6 is a block diagram of the invention in the record mode.

FIG. 7 is a block diagram of the data formatting circuitry for transferring information to and from the external nonvolatile read-write memory.

FIG. 8 is a block diagram of the invention in the play-back mode.

DETAILED DESCRIPTION OF THE INVENTION

Figure 1:
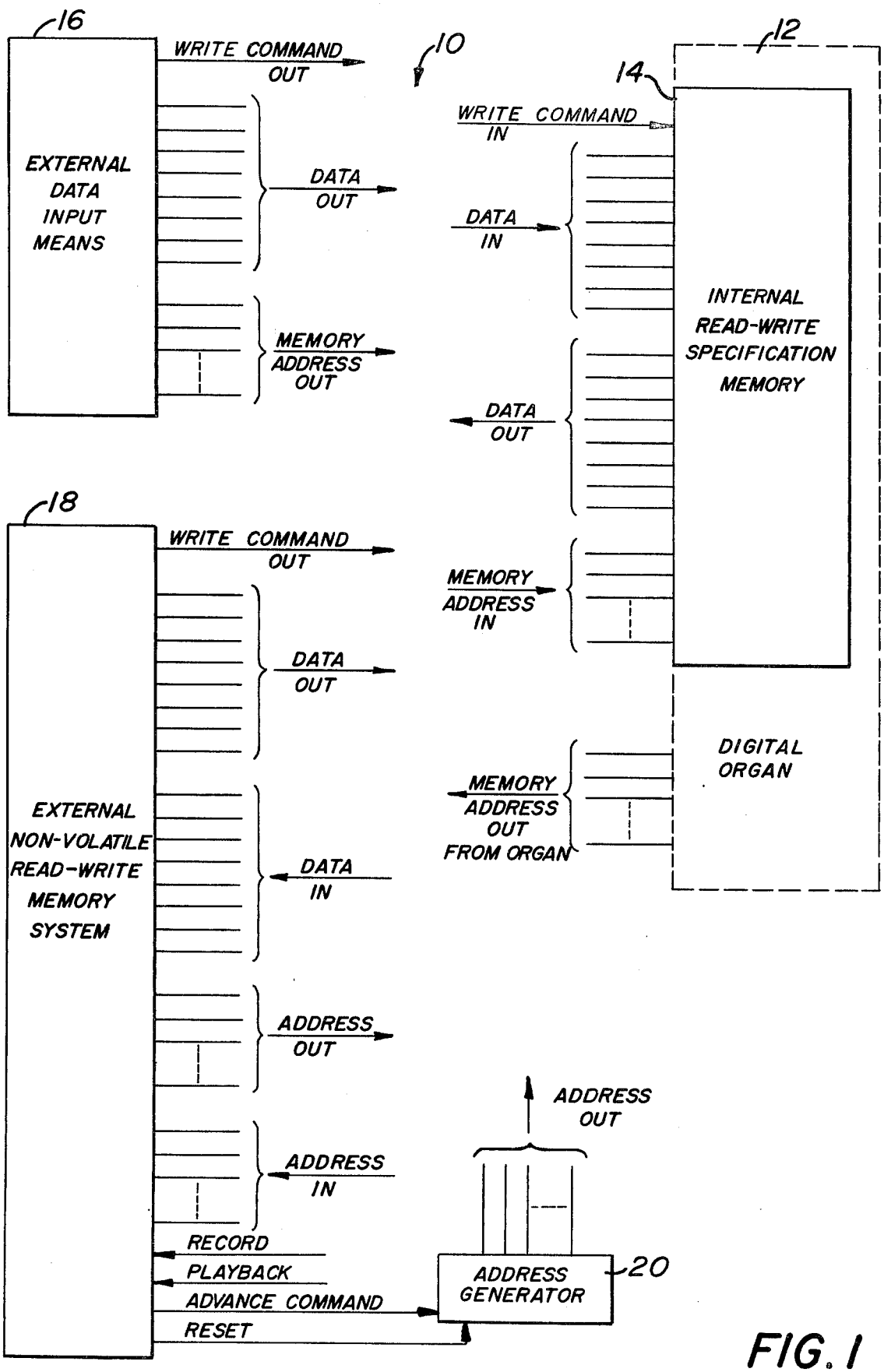
FIG. 1 is a block diagram of the basic components of the present invention.

Referring to the drawings in detail, wherein like numerals indicate like elements, there is shown in FIG. 1 a block diagram of the basic components of the present invention designated generally as 10. A conventional electronic digital organ 12 is provided with an internal read-write specification memory 14 in which is stored voice characteristic information representative of a plurality of organ voices. Preferably, specification memory 14 is a high speed memory assembled from commercially available integrated circuit chips such as the Advanced Micro Devices AM 9102 static N channel RAM. The specification memory has a multi-bit memory address input for addressing its various storage locations. In the preferred embodiment described herein, the memory is organized into sixty-four voices with thirty-two digital words per voice and eight bits per word. The data input and output lines are provided in conventional manner. A write command input is used to load the information at the memory data input into a storage location called for by the address appearing at the memory address input.

The data output lines from the specification memory are connected to the digital organ internal circuitry according to principles well known in the art. In contrast to the prior art, however, the memory address input lines are not permanently connected to the memory. Instead, these lines are made available for selective accessing as described hereinafter.

An external data input means 16 selectively provides voice characteristic information at its data output terminals for use by the specification memory 14. External data input means 16 may be a punched card reader which is selectively actuated by means of simple selector switches. In addition to the voice characteristic information provided at its data output terminals, the external data input means 16 supplies a multi-bit memory address output and a write command output for writing voice characteristic information into specification memory 14 as described hereinafter. The write command output provides an indication that the data and memory address outputs of the external data input means have settled.

The programmable voice characteristic memory system 10 also includes an external non-volatile read-write memory system 18. Preferably, memory system 18 includes a magnetic tape recorder which may be of the cassette type. Other types of external non-volatile read-write memories may also be used, however, as would be apparent to one of ordinary skill in the art. Both address and voice characteristic information are stored in and retrieved from memory system 18 via the data input and output lines and address input and output lines. Record and playback mode inputs are also provided for operating memory system 18 as described hereinafter. A write command output is provided for indicating when the data output and address output lines have settled in the playback mode.

An address generator 20 is operatively associated with memory system 18 to serially generate addresses in the record mode as explained more fully below.

The basic components of the programmable voice characteristic memory system 10 are interconnected by suitable switching circuitry (not shown) to enable operation in any of four modes listed in Table 1 below.

Table 1

| Mode | Function |
|---|---|
| Data Input | External data input means 16 supplies voice characteristic information to the specification memory 14 as a function of punched cards selectively inserted into a card reader. Typically, data for a single voice, in the form of 32 digital words, is stored on each card. The memory address output determines the location in the specification memory into which the card data is to be transferred. Each memory address output is selected by means of a simple switch arrangement. |
| Organ | Specification memory 14 is utilized by the digital organ as in the prior art. Thus, the organ can be played in the usual fashion. The organ memory address output lines control the specification memory address inputs. The organ stops will call out voices in accordance with the voice characteristic information last written into the specification memory. |
| Record | Voice characteristic information contained in the specification memory is non-destructively transferred to the external non-volatile memory 18. |
| Playback | Voice characteristic information contained in external non-volatile memory 18 is non-destructively transferred to the specification memory. |

Figure 2:
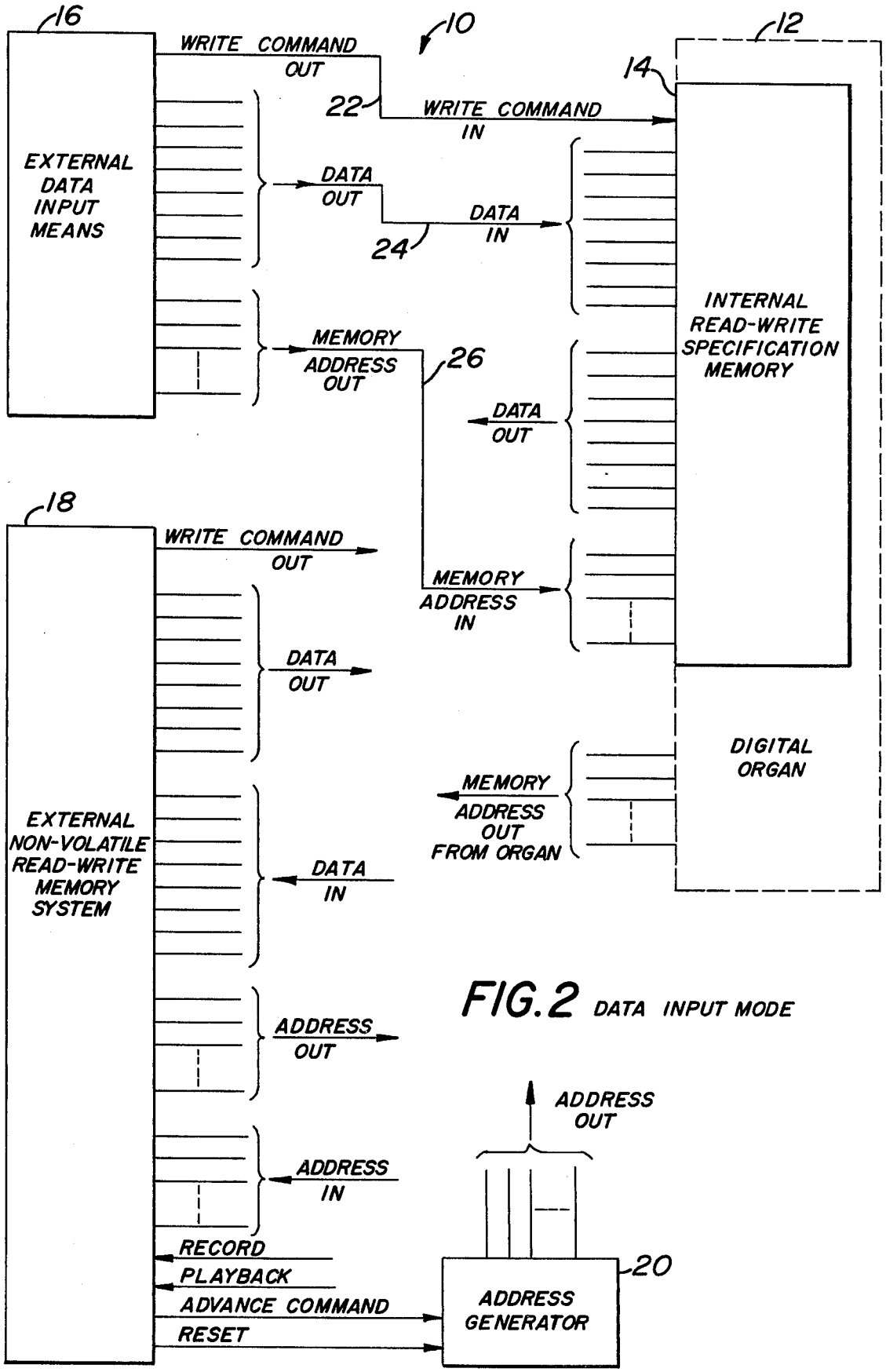
FIG. 2 is a block diagram of the invention in the data input mode.

Referring to FIG. 2, the interconnections for the data input mode are shown. The memory address, data input and write command lines for specification memory 14 are respectively connected to their counterparts at the outputs of external data input means 16. The interconnections between the external data input means 16 and the internal read-write specification memory 14 include a single data input mode write command line 22, multiple data input mode data lines 24 and multiple data input mode memory address lines 26. As previously mentioned, the system is byte orientated; that is, each data word comprises eight bits. Accordingly, the data lines 24 comprise eight lines for transferring the eight bits of word data to specification memory 14. Memory address lines 26, however, may comprise more than eight lines depending on the particular format chosen for specification memory 14.

Figure 3:
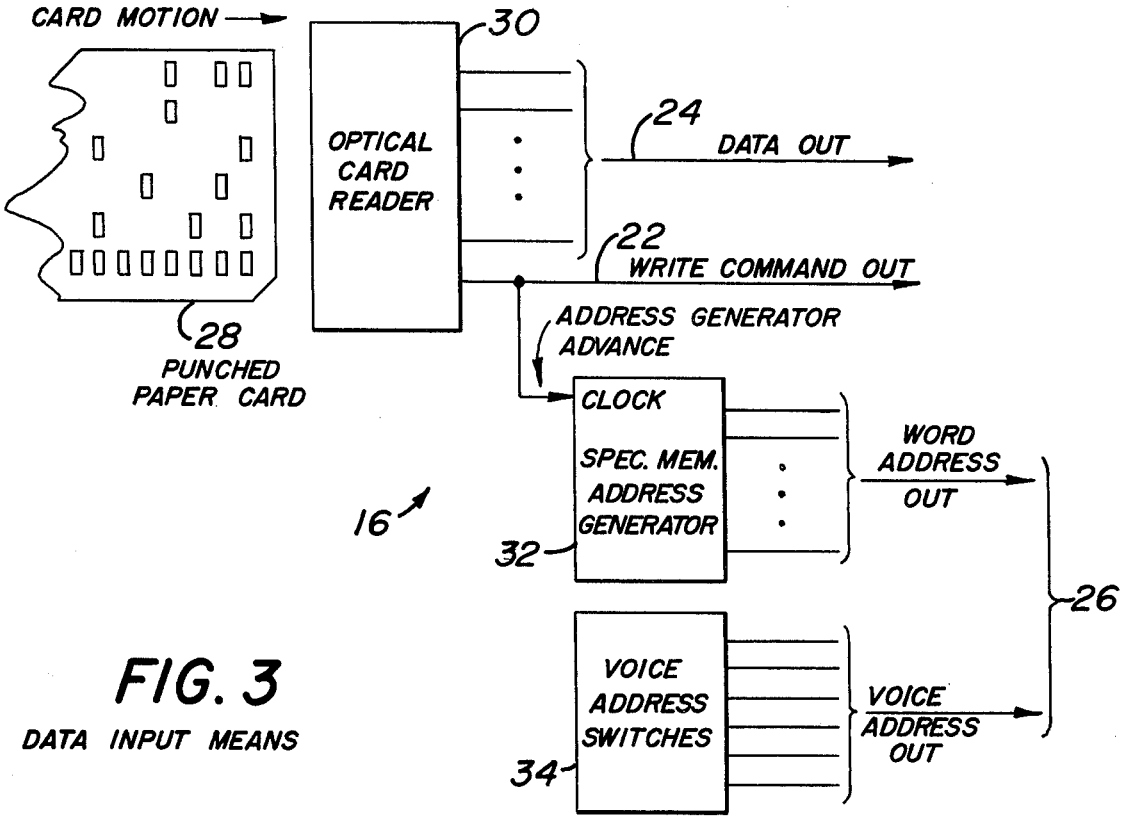
FIG. 3 is a block diagram of the internal structure of the data input means.

A preferred configuration of external data input means 16 is shown in FIG. 3. Other configurations may also be used in connection with the invention as will be apparent to one of ordinary skill in the art. Voice characteristic information is stored on a standard eighty column punched paper card 28 such as an IBM SS5081 card. An optical card reader 30 provides the word bits to be stored in specification memory 14 in parallel data format on data lines 24 as a function of the information stored on card 28. In addition, the card reader supplies a write command signal on line 22 as a function of information stored on one of the card tracks.

The memory address bits appearing on memory address lines 26 are supplied by a specification memory address generator 32 and voice address switches 34. Both the word and voice addresses are required to properly address specification memory 14. In the preferred embodiment described herein, there are thirty-two possible word addresses per voice address. Each word address consists of five bits while each voice address consists of six bits. Thus, sixty-four voices can be addressed in specification memory 14.

The specification memory address generator 32 is a digital counter clocked by the write command signal generated by card reader 30. Address generator 32 may be a RCA CD 4024 7-stage binary counter having its clock input connected to the write command line 22. Accordingly, each word address supplied by address generator 32 is determined by information stored on card 28 and detected by card reader 30. The voice address switches 34, however, supply the voice address independently of card reader 30. Voice address switches 34 comprise plural manually actuatable switches which preferably provide a binary coded digital signal output.

Figure 4:
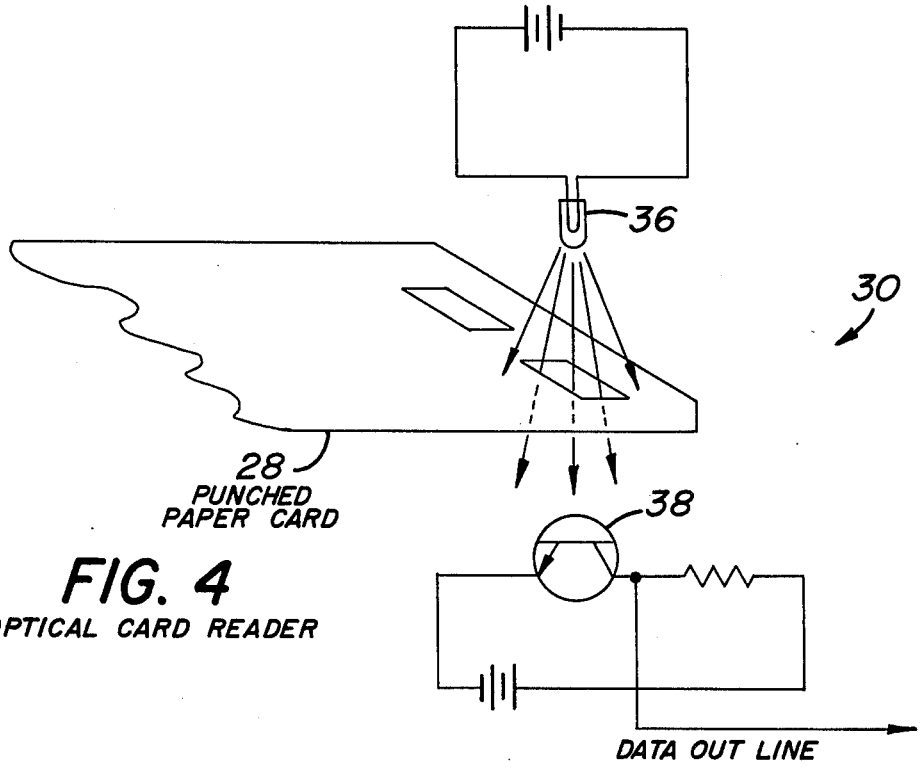
FIG. 4 is an electrical schematic of an optical punched card reader.

A preferred form of optical card reader is shown in schematic form in FIG. 4. A light source 36 illuminates restricted areas of one side of the punched paper card 28. A light detector 38 located on the opposite side of the card detects the presence or absence of light. Light source 38 may be a phototransistor such as the Motorola MRD 150 phototransistor. A binary signal is generated at the collector of the phototransistor as a function of the presence or absence of holes in the punched paper card. Although only a single light source and light detector pair is shown in FIG. 7, it should be understood that a bank of light sources and light detectors are employed to detect the voice characteristic information stored in multiple tracks on card 28.

The interconnections for operation of the programmable voice characteristic memory system 10 in the organ mode are shown in FIG. 5. In the organ mode, the memory address input lines of the specification memory 14 are accessed by the organ memory address output lines 40. The data output lines of the specification memory are permanently connected in conventional fashion by means of connector 42 to the internal circuitry of digital organ 12. The write command input to specification memory 14 is disabled in the organ mode. Specification memory 14 therefore responds in conventional fashion to the digital organ commands.

The interconnections of the programmable voice characteristic memory system for operation in the record mode are shown in FIG. 6. Voice characteristic information read out of specification memory 14 is transferred via record mode data lines 44 to the data input terminals of the external non-volatile read-write memory system 18. The memory system 18 is placed in the record mode on activating the record input by suitable switch controls. The address output lines of generator 20 are connected to the corresponding address lines of memory system 18 and specification memory 14 via record mode address lines 46.

In the record mode, the address generator 20 sequentially generates all specification memory addresses. All specification memory locations therefore are accessed in the record mode. As each address is supplied to the memory address input of specification memory 14, the voice characteristic information stored at that address is made available at the specification memory data output lines. The address generator 20 is reset and advanced at the proper times by means of the reset and advance command lines from the external non-volatile read-write memory system 18. The address information and the corresponding voice characteristic information are continuously recorded by memory system 18.

A preferred embodiment of the external non-volatile read-write memory system is shown in FIG. 7. The record input signal triggers a one-shot 48. The one-shot generates a reset pulse in response to reset address generator 20. Accordingly, the record mode always begins at the same address starting point.

The record signal also enables a gated oscillator 50. The gated oscillator generates a clock signal which clocks a word time counter 52. The word time counter divides the stream of bits to be stored in the external memory into word blocks. Thus, in the embodiment of the memory system shown in FIG. 7, the external memory is a tape recorder system 54 which stores serial voice characteristic information provided by parallel to serial converter 56. The voice characteristic information on the record mode data lines 44 and the address information on the record mode address lines 46 appear in parallel format at the input to parallel to serial converter 56. This information is converted to serial form at the parallel to serial converter output. The word time as well as the clock information is recorded along with the serial information at the output of converter 56 according to principles well known in the data recording art. The parallel to serial converter 56 may include commercially available integrated circuit chips such as the RCA CD 4021 COS/MOS 8-stage static shift register.

The word time signal is also fed to the advance command input of address generator 20 to advance the address generator to the next address. This brings the next block of parallel voice characteristic and address information into the parallel to serial converter 56. The clock signal clocks the parallel to serial converter to progressively shift the voice characteristic and address information out of the converter in serial format.

The interconnections of the programmable voice characteristic memory system 10 in the playback mode are shown in FIG. 8. The external non-volatile read-write memory system 18 is placed in the playback mode on activating the playback input by suitable switch controls. Voice characteristic information read out of the external memory system is fed via playback mode data lines 58 to the data inputs of specification memory 14. The address information read out of the external memory is fed via playback mode address lines 60 to the memory address inputs of the specification memory. The write command terminal of the memory system 18 is connected via connector 62 to its counterpart at specification memory 14.

In the playback mode, the voice characteristic, address and timing information previously recorded on the external memory is retrieved. The retrieved information appears in the same format as the information previously supplied to the inputs of external memory. Thus, the retrieved information includes voice characteristic and address information in serial format as well as clock times and word times. The clock signal is used to re-format the serial information into a parallel data format via serial to parallel converter 64. See FIG. 7. The serial to parallel converter 64 may comprise commercially available integrated circuit chips such as the RCA CD 4015 COS/MOS 4-stage static shift register. The serial information at the input to converter 64 is converted by well-known data conversion techniques to parallel information on lines 58 and 60. The retrieved word time signal is generated at the write command output of the memory system to load the parallel information at the output of converter 64 into specification memory 14 word by word.

An advantage of the invention is that it facilitates programming the specification memory of a digital organ either selectively in response to external data input means or as a function of information stored in an external non-volatile read-write memory. A virtually unlimited number of organ voices is thereby placed at the organist's disposal. In the record mode, voice characteristic information can be transferred from the specification memory to an external memory such as a magnetic tape. Each recording corresponds to a complete organ specification. An unlimited number of organ specifications can easily be accumulated by maintaining a library of such tapes. An organist may conveniently select a particular tape and write the voice characteristic information stored therein back into the specification memory in the playback mode.

The present invention may be embodied in other specific forms without departing from the spirit or essential attributes thereof and, accordingly, reference should be made to the appended claims, rather than to the foregoing specification as indicating the scope of the invention.

What is claimed is:

1. In an electronic digital organ in which digital information is used to define voice characteristics, a programmable voice characteristic memory system comprising:

an internal read-write specification memory for storage of voice characteristic information representative of a plurality of voices, an external, non-volatile read-write memory for storing voice characteristic information representative of a plurality of voices, external data input means for selectively providing voice characteristic information representative of a plurality of voices, means for writing into said internal read-write memory voice characteristic information from said external data input means, means for writing into said internal read-write memory voice characteristic information from said external, non-volatile read-write memory, means for non-destructively reading out of said internal read-write memory voice characteristic information stored therein, and means for transferring said information read from said internal read-write memory to said external non-volatile read-write memory.

2. In an electronic digital organ in which digital information is used to define voice characteristics, a programmable voice characteristic memory system according to claim 1 wherein said external data input means comprises a punched card reader.

3. In an electronic digital organ in which digital information is used to define voice characteristics, a programmable voice characteristic memory system according to claim 1 wherein said external non-volatile read-write memory comprises a magnetic tape recorder and said means for transferring information read from said internal read-write memory to said external, non-volatile read-write memory includes a parallel to serial converter for receiving said information from said internal read-write memory in parallel data format and for transmitting said information to said tape recorder in serial data format.

4. In an electronic digital organ in which digital information is used to define voice characteristics, a programmable voice characteristic memory system according to claim 1 wherein said external, non-volatile read-write memory comprises a tape recorder, and said means for writing into said internal read-write memory information from said external, non-volatile read-write memory includes a serial to parallel converter for receiving said information from said tape recorder in serial data format and for transmitting said information to said internal read-write memory in parallel data format.

5. In an electronic digital organ in which digital information is used to define voice characteristics, a programmable voice characteristic memory system according to claim 1 wherein said internal read-write memory is a random access memory.

6. In an electronic digital organ in which digital information is used to define voice characteristics, a programmable voice characteristic memory system according to claim 1 wherein said means for non-destructively reading out of said internal read-write memory includes an address generator for simultaneously addressing said external, non-volatile read-write memory and said internal read-write memory.

7. In an electronic digital organ in which digital information is used to define voice characteristics, a programmable voice characteristic memory system according to claim 1 wherein said external, non-volatile read-write memory is adapted to store and read out address information for use in writing into said internal read-write memory the voice characteristic information stored in said external, non-volatile read-write memory.

8. A method of programming an internal read-write specification memory in an electronic digital organ, comprising:

selectively providing voice characteristic information representative of a plurality of voices as a function of information stored in external data input means, storing voice characteristic information representative of a plurality of voices in an external, non-volatile read-write memory, selectively writing into said internal read-write memory voice characteristic information as a function of either of the preceding steps, non-destructively reading out said internal read-write memory voice characteristic information from said internal read-write memory, and transferring said information read from said internal read-write memory to said external, non-volatile read-write memory.

9. The method according to claim 8 wherein said step of transferring said information read from said internal read-write memory includes converting the data format of said information for storage in said external, non-volatile read-write memory.

10. The method according to claim 8 wherein said step of selectively writing into said internal read-write memory voice characteristic information includes converting the data format of said information stored in said external, non-volatile read-write memory for storage in said internal read-write specification memory.

11. In an electronic digital organ, a programmable voice characteristic memory system, comprising:

an internal read-write specification memory having plural address locations for storage of voice characteristic information representative of a plurality of voices, an external, non-volatile read-write memory for storing voice characteristic information representative of a plurality of voices, means for writing into said internal read-write memory address locations voice characteristic information from said external, non-volatile read-write memory, means for non-destructively reading out of said internal read-write memory address locations voice characteristic information stored therein and for generating information representative of said address locations, and means for writing into said external non-volatile read-write memory said voice characteristic information read from said internal read-write memory address locations together with said information representative of said address locations.

12. In an electronic digital organ, the programmable voice characteristic memory system according to claim 1 wherein said means for non-destructively reading out of said internal read-write memory includes an address generator for simultaneously addressing said external, non-volatile read-write memory and said internal read-write specification memory.

* * * * *